United States Patent [19]

Theurer et al.

[11] Patent Number: 4,903,608

[45] Date of Patent: Feb. 27, 1990

[54] MACHINE FOR LATERALLY DISPLACING A TRACK

[75] Inventors: Josef Theurer, Vienna; Friedrich Peitl, Linz, both of Austria

[73] Assignee: W. Schlafhorst & Co., Fed. Rep. of Germany

[21] Appl. No.: 331,630

[22] Filed: Mar. 30, 1989

[30] Foreign Application Priority Data

May 18, 1988 [EP] European Pat. Off. ..... 88890125

[51] Int. Cl.[4] ..... E01B 27/17

[52] U.S. Cl. ..... 104/7.2; 104/8; 104/12

[58] Field of Search ..... 104/7.1, 7.2, 7.3, 12, 104/8

[56] References Cited

U.S. PATENT DOCUMENTS 4,341,160 7/1982 Nielsen ..... 104/7.2
4,457,234 7/1984 Theurer et al. ..... 104/7.2
4,636,541 12/1986 Theurer et al. ..... 104/12

FOREIGN PATENT DOCUMENTS 310983 2/1919 Fed. Rep. of Germany .
893956 10/1953 Fed. Rep. of Germany .
2253874 7/1975 France .
100510 9/1973 German Democratic Rep. .
2126632 3/1984 United Kingdom ..... 104/7.2
2140061 11/1984 United Kingdom .

*Primary Examiner*—Andres Kashnikow
*Assistant Examiner*—Matthew C. Graham
*Attorney, Agent, or Firm*—Shefte, Pinckney & Sawyer

[57] ABSTRACT

A machine for laterally displacing a track comprises at least one vertically adjustable tamping head having reciprocable vibratory tools for tamping ballast under the ties; a compact operating unit comprising a common carrier frame, a vertically and laterally adjustable device for lifting and laterally displacing the track mounted on the common carrier frame and including rail engaging roller tools, and a vertically and longitudinally adjustable device for orienting obliquely positioned ties to assume an orientation extending substantially perpendicularly to the track in the common plane, the tie orienting device being mounted on the common carrier frame and including a tie engaging tool; and power-actuated drives linking the carrier frame of the operating unit to the machine frame for vertically and laterally adjusting the carrier frame.

16 Claims, 2 Drawing Sheets

MACHINE FOR LATERALLY DISPLACING A TRACK

BACKGROUND OF THE INVENTION (1) Field of the Invention

The present invention relates to a machine for laterally displacing a track consisting of rails fastened to ties positioned in a common plane, which comprises a machine frame, undercarriages supporting the machine frame on the track rails, at least one vertically adjustable tamping head having reciprocable vibratory tools for tamping ballast under the ties, a vertically and laterally adjustable device for lifting and laterally displacing the track, which includes rail engaging roller tools, and a vertically and longitudinally adjustable device for orienting obliquely positioned ties to assume an orientation extending substantially perpendicularly to the track in the common plane, the tie orienting device including a tie engaging tool.

(2) Description of the Prior Art

German Pat. No. 893,956, delivered Oct. 22, 1953, discloses such a machine for laterally moving or displacing a track. A track displacing head comprising rail engaging roller tools is mounted on the machine frame intermediate two undercarriages supporting respective ends of the machine frame on the track rails. A vertically adjustable tamping head comprising reciprocable vibratory tamping tools for tamping ballast under the ties is mounted on each side of the track displacing head between the centrally positioned track displacing head and a respective undercarriage. Furthermore, a vertically and longitudinally adjustable tie engaging tong is mounted on the machine frame for orienting obliquely positioned ties to assume an orientation extending substantially perpendicularly to the track in the common plane.

Track displacing machines of this type have been used in open-pit mines to move tracks at irregular time intervals closer to the mining locations as the mining progresses. As the need arises and the mining location recedes from the track, the machine is continuously advanced along the track while the roller tools of the track displacing head engage the rails and the head is laterally displaced to move the track sideways about 30 cm to 50 cm, for example. Since the track bed and the resultant resistance to the lateral movement of the track are uneven and the lateral displacement of the track displacing head is only coarsely controlled, the track is merely pulled out of its original position and drawn into its new position without any control of the track level and line. Errors in the level of the laterally displaced track are somewhat compensated for by tamping ballast under the ties of the displaced track but since no leveling reference system is provided, this depends solely on the visual observation of the operator and his experience. It is impossible accurately to level and/or line the laterally displaced track so that the speed of transport vehicles running on this track must be held very low. The track is simply moved sideways from one right-of-way to an adjacent right-of-way by engaging the track rails with the roller tools of the track displacing head, manually adjusting the head transversely according to the desired extent of the track displacement, and then continuously advancing the machine along the track. No readjustment of the track displacing head is possible during the continuous advancement of the machine. After a desired track section has thus been laterally displaced, the machine is partially intermittently advanced in an opposite direction along the displaced track, obliquely positioned ties of the displaced track are gripped by the tie engaging tong and oriented, and the ties are tamped.

Another track moving machine with rail engaging rollers has been disclosed in German Pat. No. 310,983, delivered Feb. 25, 1919. Three pairs of flanged rollers for engaging each rail are mounted on a frame and this frame is vertically adjustable on the machine frame by means of two manually operated threaded spindles. Two additional manually operated threaded spindles extending horizontally and transversely to the track enable the flanged rollers to be pivoted into engagement with the rails after the frame has been vertically adjusted to lift the track and to move the flanged rollers with the engaged rails a set distance whereby the lifted track is laterally displaced. The vertical and transverse adjustments can be effected only before the machine is advanced, the manual adjustments by spindle drives being very time-consuming and difficult due to the heavy weight of the track which must be vertically and laterally moved. Any change in the vertical and lateral adjustments can be made only if the forward movement of the machine is interrupted.

German Democratic Republic Pat. No. 100,510, delivered Sept. 20, 1973, discloses a device for orienting obliquely positioned ties in a movable track. This device is mounted on the machine frame of a track moving machine of the above-indicated type and comprises two vertically adjustable tie engaging rams having V-shaped points for engaging and pushing misoriented ties into substantially parallel alignment with each other. Hydraulic operating cylinders are used for vertically adjusting the rams and for pivoting them in the direction of the track. The tie orientation is effected while the track moving head is raised and engages the rails. The points of the tie engaging rams have the shape of a sword blade, the edges of the ram points enclosing a relatively large angle of about 80°, which makes penetration of the rams between two closely adjacent ties difficult. Since the rams are suspended like a pendulum, their points move along a circular path when the rams push the ties to orient them, the contact between the ram point and the tie moving upwardly, which causes friction that may damage the tie.

French Pat. No. 2,253,874, published July 4, 1975, also discloses a tie positioning device mounted on a machine frame between undercarriages supporting the machine frame on a track, which device comprises vertically adjustable clamps operable to grip the ties.

U.S. Pat. No. 4,457,234, dated July 3, 1984, discloses a track leveling, lining and tamping machine capable of accurately positioning a track. This machine comprises a tamping head and a track lifting and lining device preceding the tamping head and linked to the machine frame between the two undercarriages supporting the machine frame for mobility on the track. The device comprises a carrier frame supporting lifting rollers and flanged wheels serving as lining tools, and power-actuated drives link the carrier frame to the machine frame for vertically and laterally adjusting the track lifting and lining device. The machine also carries a leveling and lining reference system controlling the power-actuated drives so that minor track position errors may be corrected in response to the reference system. The usual lining of existing tracks along their right-of-way involves lateral track displacements of about two to ten millimeters. After leveling, lining and tamping the track with such a machine, the track is accurately leveled and lined.

British Pat. No. 2,140,061, published November 21, 1984, discloses a similar track leveling, lining and tamping machine incorporating a track lifting and lining device with a vertically adjustable lifting hook instead of lifting rollers.

SUMMARY OF THE INVENTION

It is the primary object of this invention to provide a track moving machine of the first-described type with an enhanced track displacement and tie orientation capability enabling the operation to proceed faster and simpler even with heavy tracks.

The above and other objects are accomplished with a machine for laterally displacing a track consisting of rails fastened to ties positioned in a common plane, which comprises a machine frame, undercarriages supporting the machine frame on the track rails, and at least one vertically adjustable tamping head having reciprocable vibratory tools for tamping ballast under the ties. According to the invention, the machine comprises a compact operating unit comprising a common carrier frame, a vertically and laterally adjustable device for lifting and laterally displacing the track mounted on the common carrier frame and including rail engaging roller tools, and a vertically and longitudinally adjustable device for orienting obliquely positioned ties to assume an orientation extending substantially perpendicularly to the track in the common plane, the tie orienting device being mounted on the common carrier frame and including a tie engaging tool. Power-actuated drives link the carrier frame of the operating unit to the machine frame for vertically and laterally adjusting the carrier frame.

According to another aspect of the present invention, there is provided a method of laterally displacing a track with such a machine, which comprises the steps of continuously advancing the machine along the track in a first operating stage while engaging the track rails with the roller tools and actuating the power-actuated drives to displace the track laterally by about 30 cm to about 50 cm, orienting obliquely positioned ties of the laterally displaced track in a second operating stage while partially intermittently advancing the machine in an opposite direction, lowering the vertically adjustable tie orienting device into engagement of the obliquely positioned ties, and longitudinally adjusting the lowered tie orienting device until the obliquely positioned ties have assumed an orientation extending substantially perpendicularly to the track in the common plane. The laterally displaced track is then leveled, lined and tamped in a third operating stage while intermittently advancing the machine in the first direction, engaging the track rails of the displaced track with the roller tools, actuating the power-actuated drives under the control of the leveling and lining reference system to level and line the displaced track, and tamping ballast under the ties of the displaced track.

The provision of the compact operating unit and its power-actuated drives makes it possible to lift and laterally displace the track along any desired lateral displacement path rapidly and simply by remote control of the drives. Without interrupting the continuous advance of the machine during the track displacement operation, the device for lifting and laterally displacing the track may be vertically and/or laterally adjusted at any time to obtain any desired track level and/or line. The tie orientation is preferably effected in the second operating stage, at which time coarse, clearly visible lining errors may be corrected. If an extended section of the displaced track has no misoriented ties, i.e. if the ties are aligned substantially parallel to each other perpendicularly to the track, the lifting drives may be actuated by remote control to lower the displaced track onto the ballast bed and, if desired for a faster advance of the machine along the displaced track, the roller tools may be temporarily disengaged from the rails. Since the tie orienting device and the device for lifting and laterally displacing the track are combined in a compact operating unit, an automatic centering of the devices with respect to the track is assured. This is of particular advantage since the laterally displaced track, particularly in case of a substantial lateral displacement, may deviate considerably and irregularly from the longitudinal center line of the machine frame. The known tie orienting devices are mounted on the machine frame and, therefore, they must be centered at each tie being oriented, which is avoided with the operating unit of the present invention.

Using the machine in the three sequential operating stages according to one aspect of this invention provides a particularly economical and rapid lateral track displacement, in which the displaced track may be accurately leveled and lined immediately after its displacement. Therefore, the displaced track may be promptly used in traffic.

BRIEF DESCRIPTION OF THE DRAWING

The above and other objects, advantages and features of the invention will become more apparent from the following detailed description of a now preferred embodiment thereof, taken in conjunction with the accompanying drawing wherein.

DETAILED DESCRIPTION OF THE PREFERRED EMBODIMENT

Figures 1, 2, 3, 4:
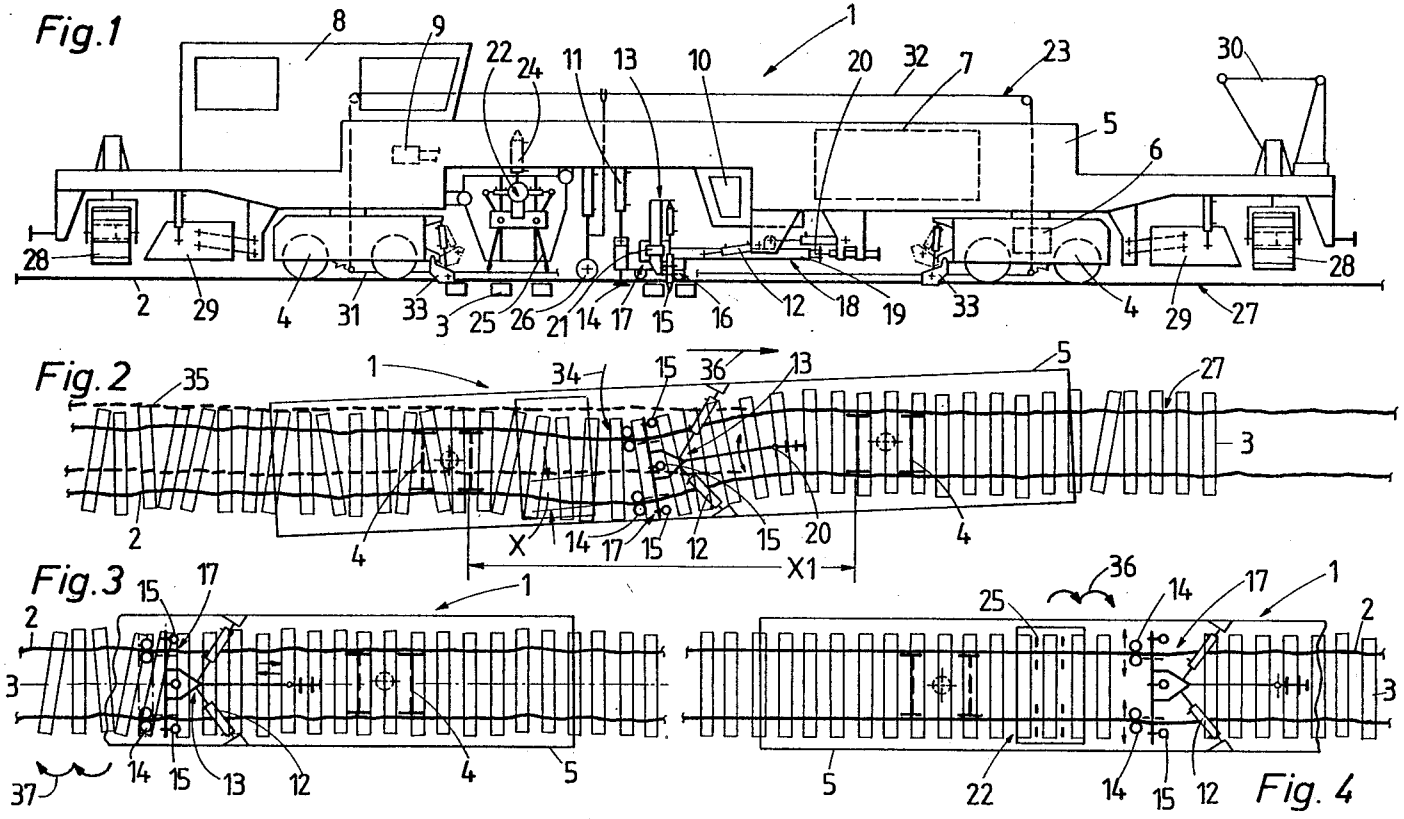
FIG. 1 is a side elevational view of a machine for laterally displacing a track embodying the present invention.
FIG. 2 is a reduced and schematic top view of the machine of FIG. 1 on a partially laterally displaced track.
FIG. 3 is a similar view illustrating the orientation of obliquely positioned ties during an intermittent advance along the displaced track.
FIG. 4 is a like view illustrating the leveling, lining and tamping of the displaced track under the control of a track leveling and lining reference system.

FIG. 1 shows machine 1 for laterally displacing track 27 consisting of rails 2 fastened to ties 3 positioned in a common plane. The machine comprises machine frame 5 and undercarriages 4, which consist of swivel trucks, supporting machine frame 5 on track rails 2. Drive 6 for advancing the machine along the track is connected to hydraulic power source 7 whose hydraulic pump supplies power to all the operating drives. Tamping head 22 is vertically adjustably mounted on machine frame 5 and has reciprocable vibratory tamping tools 25 for tamping ballast under the ties. Vertical adjustment drive 24 links the tamping head to the machine frame for vertical adjustment of the tamping head.

According to the invention, machine 1 comprises compact operating unit 17 comprising common carrier frame 18, vertically and laterally adjustable device 13 for lifting and laterally displacing the track mounted on common carrier frame 18 and including rail engaging roller tools 14, 15, and vertically and longitudinally adjustable device 16 for orienting obliquely positioned ties 3 to assume an orientation extending substantially perpendicularly to the track in the common plane, tie orienting device 16 being mounted on common carrier frame 18 and including tie engaging tool 15. Power-actuated, i.e. hydraulic, drives 11, 12 link the common carrier frame of operating unit 17 to machine frame 5 for vertically and laterally adjusting the carrier frame. The machine frame carries a first operator's cab 10 associated with the operating unit and housing central operating control panel 9, tamping head 22 and device 13 for lifting and laterally displacing the track being in view of cab 10, and second operator's cab 10 mounted on the machine frame between swivel trucks 4 and above common carrier frame 18 of the operating unit. The arrangement of the second operator's cab brings the tie orienting device within ready view of an operator so that obliquely positioned ties may be readily and rapidly oriented after the track has been laterally displaced.

Figure 5:
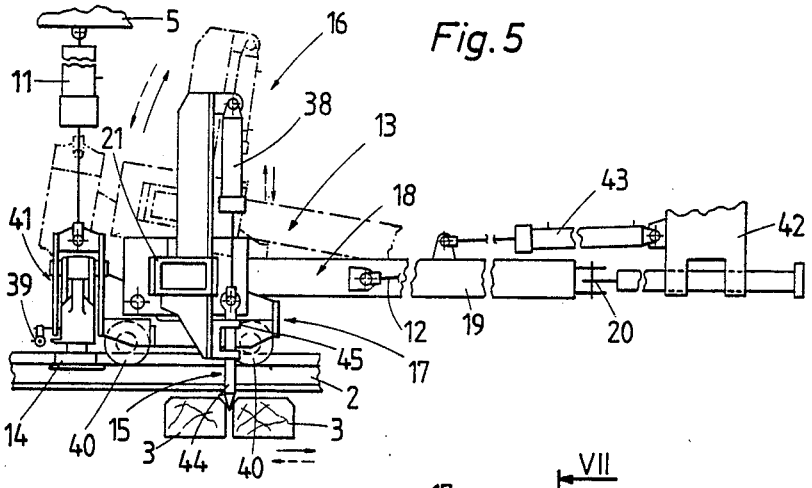
FIG. 5 is an enlarged, fragmentary side view showing the compact operating unit of the machine.
Figure 6:
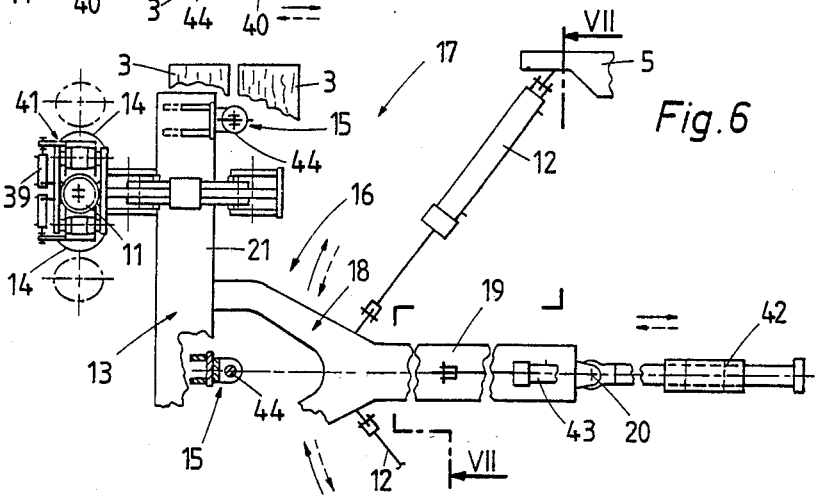
FIG. 6 is a fragmentary top view of the operating unit shown in FIG. 5.
Figure 7:
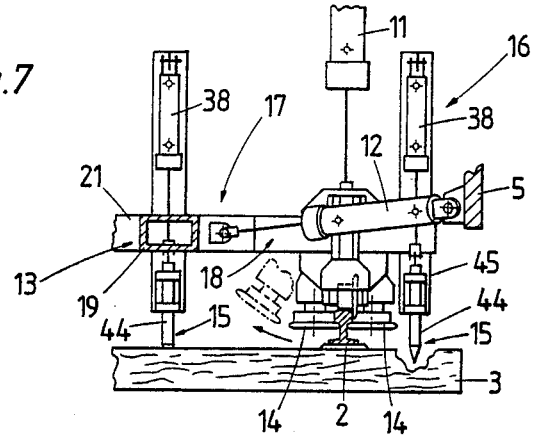
FIG. 7 is a reduced sectional view along line VII—VII of FIG. 6.

In the preferred embodiment illustrated best in FIGS. 5 to 7, carrier frame 18 of operating unit 17 is substantially T-shaped and comprises cross carrier beam 21 extending transversely to the track and elongated carrier beam 19 extending in the direction of the track substantially centrally between rails 2 thereof (see FIG. 4). The elongated carrier beam has a free end and universal joint 20 connects the free carrier beam end to machine frame 5 whereby elongated carrier beam 19 may be pivoted vertically and laterally about the universal joint. Two hydraulic drives 11 for vertically adjusting carrier frame 18 are linked to the carrier frame in alignment with respective end regions of cross carrier beam 21 and two hydraulic drives 12 for laterally adjusting the carrier frame are linked to respective sides of elongated carrier beam 19. This construction is simple and provides a robust operating unit to which drives 11, 12 may transmit considerable lifting and lateral displacement forces for moving heavy tracks along relatively long displacement paths. The hydraulic drives are capable of transmitting vertical and lateral forces simultaneously.

In the preferred embodiment, tie orienting device 16 is mounted on cross carrier beam 21 of T-shaped carrier frame 18. The machine further comprises power-actuated, i.e. hydraulic, drive 38 for vertically adjusting the tie orienting device on the cross carrier beam and tool carrier 41 arranged at each cross carrier beam end to which a respective vertical adjustment drive 11 is linked. Each tool carrier is equipped with a pair of rail-engaging roller tools 14 and flanged wheels 40 supporting the carrier frame on rails 2. Guide bracket 42 longitudinally displaceably mounts the free carrier beam end and universal joint 20 on machine frame 5, and another hydraulic drive 43 links the free carrier beam end to the machine frame for longitudinally displacing carrier frame 18 in the direction of the track. This arrangement not only enables the operator in cab 10 clearly to view the tie orientation and the track correction but also avoids any interference between the tie orienting and rail engaging tools. The longitudinal displacement of the carrier frame does not only serve to push the obliquely positioned ties into their properly oriented position but also rapidly and accurately centers the tie orienting device with respect to the obliquely positioned ties. This saves the time and power otherwise required for centering by movement of the entire machine.

As shown in FIGS. 5 to 7, tie orienting device 16 comprises tie-engaging rams 44 respectively displaceable in guide brackets 45 affixed to the cross carrier beam ends and intermediate the ends thereof, and the power-actuated drive vertically adjusting the tie orienting device on the cross carrier beam comprises hydraulic drive 38 linked to each ram. The tie-engaging rams have wedge- or conically-shaped ends for engagement with the ties and preferably have a thickness of about 6 cm. The arrangement of relatively widely spaced and independently operable tie-engaging rams facilitates the engagement of tightly adjoining ties 3 (see FIG. 5) so that they may be rapidly pushed apart and brought into their proper position. Because the rams are vertically guided in fixed guides, a torsion-free force transmission is assured. Tie-engaging rams having the illustrated ends and preferred thickness operate like bolts insertable simply, rapidly and trouble-free even in small gaps between closely adjacent ties so that they may be properly aligned.

As shown in FIG. 1, rail-engaging roller tools 14 for lifting the track are arranged at a side of cross carrier beam 21 facing tamping head 22 and tie orienting device 16, i.e. rams 44, is arranged at a side of the cross carrier beam facing away from the tamping head. This arrangement makes it possible to lift the track as close as possible to the tamping head without interference by the tie orienting operation.

The illustrated machine is a track leveling, lining and tamping machine whose swivel trucks 4, 4 are sufficiently spaced in the direction of the track to enable rails 2 to be freely flexed during vertical and lateral displacement of the track between the swivel trucks. Operating unit 17 is mounted underneath machine frame 5 immediately preceding tamping head 22 in an operating direction. The machine further comprises leveling and lining reference wire system 23 controlling power-actuated drives 11, 12 linking carrier frame 18 of the operating unit to the machine frame for vertically and laterally adjusting the carrier frame and thereby to level and line the track. Rail position sensing roller 26 is vertically adjustably supported on each rail and cooperates with the reference wire to signal the actual level of the track adjacent lifting rollers 14. Such a machine makes it possible to displace a track laterally a substantially distance of about 30–50 cm, or more, and then immediately to level and/or line the displaced track accurately within the millimeter range. This lining and leveling operation can proceed substantially in the same operation without requiring time-consuming machine changes.

In the operation of such a track leveling, lining and tamping machine, the machine may be advanced continuously along the track in a first operating stage while engaging track rails 2 with roller tools 14, 15 and actuating power-actuated drives 11, 12 to lift and displace the track laterally at least about 30 cm to about 50 cm. Obliquely positioned ties 3 of the laterally displaced track are oriented in a second operating stage while partially intermittently advancing the machine in an opposite direction, lowering vertically adjustable tie orienting device 16 into engagement of the obliquely positioned ties, and longitudinally adjusting the lowered tie orienting device until the obliquely positioned ties have assumed an orientation extending substantially perpendicularly to the track in the common plane. The laterally displaced track is leveled, lined and tamped in a third operating stage while intermittently advancing the machine in the original direction, engaging the track rails of the displaced track with the roller tools, actuating the power-actuated drives under the control of leveling and lining reference system 23 to level and line the displaced track, and tamping ballast under the ties of the displaced track.

The coarse lateral track displacement as well as the lining and leveling can be effected by remote control of the various operating drives located on the same operating unit. In the first operating stage, during which the machine is advanced in a first direction, the reference system may be switched off since only a coarse track displacement is effected. In the second operating stage, during which the machine is advanced on the displaced track in a direction opposite to the first direction, obliquely positioned ties are aligned by lowering the tie-engaging rams into engagement with such ties and longitudinally displacing the carrier frame which vertically adjustably supports the tie-engaging rams automatically centered with respect to the ties. In the third operating stage, the machine is again advanced in the original direction and the reference system is switched on to level and line the displaced track whose ties have been properly oriented. In this manner, the displaced track may be immediately used to support freight train traffic. If the coarse track displacement in the first operating stage is insufficient to obtain the desired displacement, this operation may be repeated to move track 27 further sideways.

It is desirable for hydraulic drives 12 to have a stroke sufficient to permit a lateral displacement path X of at least about half an average crib width up to about half the track gage, for example about 70 cm, and undercarriages 4, 4 to be spaced apart at least about twelve crib widths, i.e. about 10 m. This assures an economical operation under various conditions while neither the rails nor the rail fastening elements will be subjected to undue stresses during the track displacement.

To facilitate larger lateral track displacements, the machine comprises a respective retractible full-track undercarriage 28 arranged under each end of machine frame 5, the full-track undercarriages having tracks extending transverse to track rails 2 and each full-track undercarriage having its own drive, and a respective retractible ballast plow 29 mounted on the machine frame between each full-track underriage 28 and swivel truck 4. The full-track undercarriages enable machine 1 to be rapidly moved off and onto track 27 to allow trains to pass. If the lateral track displacement path is large and the track displacement encounters considerable resistance, the full-track undercarriages may be lowered and driven to assist in the sideways movement of the track. The ballast plows may be lowered and operated to remove accumulations of ballast or waste and to smooth the surface of the right-of-way on which the displaced track rests.

An auxiliary crane 30 is carried on an end of machine frame 5 opposite to the end carrying operator's cab 8. Leveling and lining reference system 23 comprises lining control wire 31 and leveling control wire 32. Each swivel truck 4 has a support 33 arranged to engage rail 2 upon vertical adjustment by a hydraulic drive to hold the swivel truck in firm engagement on the track rails.

As schematically illustrated in FIG. 2, one or the other hydraulic drive 12 of device 13 for lifting and laterally displacing track 27 may be actuated to move the track sideways a considerable distance X of, for example, 30 cm with respect to a longitudinal center line of machine 1 from its original position 35 shown in broken lines in the direction of arrow 34. During this lateral displacement by drive 12, drives 11 are actuated to lift the track off the track bed to facilitate its sideways movements and the machine is continuously advanced in an operating direction indicated by arrow 36.

The second operating stage is shown in FIG. 3 when the machine is intermittently advanced in an opposite direction, as indicated by arcuate arrows 37. During this return pass of the machine over the displaced track, the tie orienting tools are lowered into engagement with any obliquely positioned ties 3 encountered along the displaced track while track lifting rollers 14 are preferably pivoted out of engagement with rails 2 (see phantom lines in FIG. 7). Device 13 for lifting and laterally displacing the track is centered between the rails while tie orienting device 16 is in operation.

In the third operating stage shown in FIG. 4, the machine is also advanced intermittently (see arcuate arrows) but in the original direction indicated by arrow 36. At this stage, the displaced track is leveled and lined under the control of reference system 23 and the leveled and lined track is fixed in its desired position by tamping ballast under ties 3.

The operation of machine 1 will now be described in detail in connection with a track 27 running along an open-pit mining location for freight cars transporting mined material:

When the base has been mined to such an extent that the track is too far from the mining location and it is, therefore, necessary to move the track closer thereto, machine 1 is driven to the section of the track to be laterally displaced towards the mining location. This may be done either by operating drive 6 to move the machine along the track on swivel trucks 4, 4 or the machine may be moved to the site along an adjacent track and then be laterally moved by means of full-track undercarriages 28 onto the track to be displaced. When the machine is in position at the operating site, hydraulic drives 11 are actuated to lower operating unit 17 until flanged wheels 40 engage track rails 2. Rollers 14 are then pivoted into engagement with the rails by actuating pivoting drives 39 linked to the rollers. Rail engaging devices 33 are also lowered into engagement with rails 2 to hold swivel trucks 4, 4 firmly on the track. Full-track undercarriages 28, plows 29, rail position sensing rollers 26 and tamping heads 22 remain in their retracted positions vertically spaced from track 27.

With roller tools 14 in engagement with the track rails, drives 11 are actuated to lift carrier frame 18 of operating unit 17 slightly and to raise track 27 correspondingly off the ballast bed in the range of the operating unit. To displace the lifted track laterally in the direction of arrow 34, one of hydraulic drives 12 is actuated, causing the operating unit with track 27 clamped thereto to be pushed sideways. In this eccentric position of the operating unit with respect to machine frame 5, machine 1 is continuously advanced in the direction of arrow 36 along track 27, either by actuating drive 6 or, if desired, by coupling machine 1 to a locomotive which will pull the machine in the operating direction. During the continuous advance of the machine, the operator in cab 10 may actuate a respective hydraulic drive 11 and/or 12 by remote control to correct the level and/or the lateral displacement in any desired manner indicated by the visual observation of the operation. For example, if the machine encounters a ballast accumulation resisting the lateral displacement of track 27 to the new right-of-way, drives 11 may immediately be actuated by remote control and without interrupting the continuous advance of the machine to raise operating unit 17 and the track clamped thereto to the level of this ballast accumulation. Similar adjustments may be made in the sideways stroke of drives 12 to adjust the lateral displacement in a desired manner. Therefore, the machine may advance without interruption at a relatively high speed.

After the track has been laterally displaced in the first operating stage shown in FIG. 2, the direction of advance of the machine on the displaced track is reversed and the machine proceeds intermittently in the second operating stage shown in FIG. 3. During this stage, rollers 14 are disengaged from rails 2 and drives 38 are actuated to lower tie-engaging rams 44 (tie orienting tools 15) between ties 3 while the machine stands still. Drive 43 is actuated to displace carrier frame 18 longitudinally along guide 42 so that one or the other ram, or all three rams, engage an obliquely positioned tie and push it into a properly aligned position extending perpendicularly to the track. As soon as the tie has been oriented properly, rams 44 are raised and the machine is advanced to the next obliquely positioned tie, where the orienting operation is repeated. While the machine is advanced, it is possible to correct visible lining errors in track 27 by temporarily re-engaging rollers 14 with rails 2 and actuating a selected drive 12 for laterally displacing the track until the detected lining error has been corrected. This preliminary alignment will facilitate the final lining in the third operating stage. As soon as such a visible lining error has been corrected, drives 39 may be rapidly actuated by remote control to disengage rollers 14 from the rails, and the actuation of lining drive 12 is discontinued.

Finally, in the third operating stage shown in FIG. 4, the displaced track is leveled and lined under the control of reference system 23 while rail position sensing roller 26 is lowered into engagement with the rail and the machine is advanced intermittently. The leveling and lining control signals are transmitted by reference wires 32, 33 to control panel 9 which serves for actuation of hydraulic drives 11, 12 to level and line the track clamped to operating unit 17. At each tie, tamping head 22 is lowered and tamping tools 25 are vibrated and reciprocated to tamp ballast under ties 3 of the leveled and lined track. The lining in this operating stage normally covers a range of a few centimeters and may be accurate into the range of millimeters. Thus, the displaced track is sufficiently leveled and lined to make a relatively rapid and secure traffic of transport cars over the track possible.

If and when desired, plows 29 may be lowered to smooth the bed of the new right-of-way and/or to remove waste that may have falled onto this bed.

While operating unit 17 has been shown arranged between the two undercarriages supporting machine frame 5 on the track, it may also be mounted on a cantilevered machine frame portion projecting beyond one of the undercarriages. Also, only two tie orienting tools 15 may be used and, in addition to being independently vertically adjustable, each of the tie orienting tools may be linked to an independently operable drive for longitudinally adjusting the tools so that each tie orienting tool may be independently longitudinally adjusted, in addition to the longitudinal adjustment of carrier frame 18 by drive 43.

What is claimed is:

1. A machine for laterally displacing a track consisting of rails fastened to ties positioned in a common plane, which comprises (a) a machine frame, (b) undercarriages supporting the machine frame on the track rails, (c) at least one vertically adjustable tamping head having reciprocable vibratory tools for tamping ballast under the ties, (d) a compact operating unit comprising (1) a common carrier frame, (2) a vertically and laterally adjustable device for lifting and laterally displacing the track mounted on the common carrier frame and including rail engaging roller tools, and (3) a vertically and longitudinally adjustable device for orienting obliquely positioned ties to assume an orientation extending substantially perpendicularly to the track in the common plane, the tie orienting device being mounted on the common carrier frame and including a tie engaging tool, and (e) power-actuated drives linking the carrier frame of the operating unit to the machine frame for vertically and laterally adjusting the carrier frame.

2. The track displacing machine of claim 1, wherein the carrier frame of the operating unit is substantially T-shaped and comprises a cross carrier beam extending transversely to the track and an elongated carrier beam extending in the direction of the track substantially centrally between the rails thereof and having a free end, further comprising a universal joint connecting the free carrier beam end to the machine frame whereby the elongated carrier frame may be pivoted vertically and laterally about the universal joint, two power-actuated drives for vertically adjusting the carrier frame being linked to the carrier frame in alignment with respective end regions of cross carrier beam and two power-actuated drives for laterally adjusting the carrier frame being linked to respective sides of the elongated carrier beam.

3. The track displacing machine of claim 2, wherein the tie orienting device is mounted on the cross carrier beam of the T-shaped carrier frame, further comprising a power-actuated drive for vertically adjusting the tie orienting device on the cross carrier beam, a tool carrier arranged at each cross carrier beam end to which a respective one of the power-actuated vertical adjustment drives is linked, each tool carrier being equipped with a pair of the rail-engaging roller tools and flanged wheels supporting the carrier frame on the rails, a guide longitudinally displaceably mounting the free carrier beam end and the universal joint on the machine frame, and another power-actuated drive linking the free carrier beam end to the machine frame for longitudinally displacing the carrier frame in the direction of the track.

4. The track displacing machine of claim 3, wherein the tie orienting device comprises respective tie-engaging rams vertically displaceable in guides affixed to the cross carrier beam ends and the power-actuated drive for vertically adjusting the tie orienting device on the cross carrier beam comprises power-driven drives linked to the rams.

5. The track displacing machine of claim 4, wherein the tie orienting device comprises a third tie-engaging ram vertically displaceable in guides affixed to the cross carrier beam intermediate the ends thereof and the power-actuated drive for vertically adjusting the tie orienting device on the cross carrier beam comprises a power-driven drive linked to the third ram.

6. The track displacing machine of claim 5, wherein the tie-engaging rams have wedge- or conically-shaped ends for engagement with the ties.

7. The track displacing machine of claim 6, wherein the rams have a thickness of about 6 cm.

8. The track displacing machine of claim 3, wherein the rail-engaging roller tools are arranged at a side of the cross carrier beam facing the tamping head and the tie orienting device is arranged at a side of the cross carrier beam facing away from the tamping head.

9. The track displacing machine of claim 1, wherein the undercarriages are sufficiently spaced in the direction of the track to enable the rails between the undercarriages to be freely flexed during vertical and lateral displacement of the track, the operating unit is mounted underneath the machine frame immediately preceding the tamping head in an operating direction, and further comprising a leveling and lining reference system controlling the power-actuated drives linking the carrier frame of the operating unit to the machine frame for vertically and laterally adjusting the carrier frame and thereby to level and line the track.

10. The track displacing machine of claim 1, further comprising a first operator's cab associated with the operating unit, the tamping head and the device for lifting and laterally displacing the track being in view of the first operator's cab, and a second operator's cab mounted on the machine frame between the undercarriages and above the common carrier frame of the operating unit.

11. The track displacing machine of claim 1, further comprising a respective retractible full-track undercarriage arranged under each end of the machine frame, the full-track undercarriages having tracks extending transversely to the track rails.

12. The track displacing machine of claim 11, wherein the undercarriages supporting the machine frame on the track rails are swivel trucks.

13. The track displacing machine of claim 12, further comprising a respective retractible ballast plow mounted on the machine frame between each full-track undercarriage and swivel truck.

14. The track displacing machine of claim 1 wherein the power-actuated drives for laterally displacing the track have a stroke sufficient to permit a lateral displacement path of at least about half an average crib width up to about half the track gage, and the undercarriages are spaced apart at least about twelve crib widths.

15. The track displacing machine of claim 14, wherein the lateral displacement path is about 70 cm and the undercarriages are spaced apart about 10 m.

16. A method of laterally displacing a track consisting of rails fastened to ties positioned in a common plane with a machine which comprises a machine frame, undercarriages supporting the machine frame on the track rails, at least one vertically adjustable tamping head having reciprocable vibratory tools for tamping ballast under the ties, a compact operating unit comprising a common carrier frame, a vertically and laterally adjustable device for lifting and laterally displacing the track mounted on the common carrier frame and including rail engaging roller tools, and a vertically and longitudinally adjustable device for orienting obliquely positioned ties to assume an orientation extending substantially perpendicularly to the track in the common plane, the tie orienting device being mounted on the common carrier frame and including a tie engaging tool, power-actuated drives linking the carrier frame of the operating unit to the machine frame for vertically and laterally adjusting the carrier frame, and a leveling and lining reference system controlling the power-actuated drives linking the carrier frame of the operating unit to the machine frame for vertically and laterally adjusting the carrier frame and thereby to level and line the track, which comprises the steps of (a) continuously advancing the machine along the track in a first operating stage while
  (1) engaging the track rails with the roller tools and
  (2) actuating the power-actuated drives to displace the track laterally at least about 30 cm to about 50 cm, (b) orienting obliquely positioned ties of the laterally displaced track in a second operating stage while
  (1) partially intermittently advancing the machine in an opposite direction,
  (2) lowering the vertically adjustable tie orienting device into engagement of the obliquely positioned ties, and
  (3) longitudinally adjusting the lowered tie orienting device until the obliquely positioned ties have assumed an orientation extending substantially perpendicularly to the track in the common plane, and (c) lining, leveling and tamping the laterally displaced track in a third operating stage while
  (1) intermittently advancing the machine in the direction of step (a),
  (2) engaging the track rails of the displaced track with the roller tools,
  (3) actuating the power-actuated drives under the control of the leveling and lining reference system to level and line the displaced track, and
  (4) tamping ballast under the ties of the displaced track.

* * * * *

UNITED STATES PATENT AND TRADEMARK OFFICE

CERTIFICATE OF CORRECTION

PATENT NO. : 4,903,608

DATED : February 27, 1990

INVENTOR(S) : Josef THEURER and Friedrich PEITL

It is certified that error appears in the above-identified patent and that said Letters Patent is hereby corrected as shown below:

Cover page, column 1, item [73], delete lines 1 and 2 in their entirety and substitute therefor --Franz Plasser Bahnbaumaschinen-Industriegesellschaft mbH, Austria--.

Column 2, item [56], delete line 7 in its entirety and substitute therefor --Kurt Kelman--.

Signed and Sealed this

Thirteenth Day of August, 1991

*Attest:*

HARRY F. MANBECK, JR.

*Attesting Officer*

*Commissioner of Patents and Trademarks*